US011118392B2

(12) United States Patent
McNabb et al.

(10) Patent No.: US 11,118,392 B2
(45) Date of Patent: Sep. 14, 2021

(54) SWINGING DOOR OPERATOR

(71) Applicant: Vengeance Creek, LLC, El Dorado, AR (US)

(72) Inventors: William McNabb, El Dorado, AR (US); Jeffrey McNabb, El Dorado, AR (US)

(73) Assignee: Vengeance Creek, LLC, El Dorado, AR (US)

( * ) Notice: Subject to any disclaimer, the term of this patent is extended or adjusted under 35 U.S.C. 154(b) by 132 days.

(21) Appl. No.: 16/511,473

(22) Filed: Jul. 15, 2019

(65) Prior Publication Data

US 2021/0017803 A1 Jan. 21, 2021

(51) Int. Cl.
*E05F 15/02* (2006.01)
*E05F 15/63* (2015.01)

(52) U.S. Cl.
CPC ..... *E05F 15/63* (2015.01); *E05F 2015/631* (2015.01); *E05Y 2900/132* (2013.01)

(58) Field of Classification Search
CPC ..... E05F 15/63; E05F 2015/631; E05Y 2900/132
USPC ..... 49/346, 339, 341, 340
See application file for complete search history.

(56) References Cited

U.S. PATENT DOCUMENTS 3,864,875 A 2/1975 Hewitt
5,018,304 A 5/1991 Longoria
6,177,771 B1 1/2001 Kinzer et al.
7,373,756 B2 * 5/2008 Okulov ..... E05F 15/41 49/339
7,859,203 B2 * 12/2010 Miyashita ..... E05F 15/60 318/266
8,169,169 B2 5/2012 Hass et al.
8,225,458 B1 * 7/2012 Hoffberg ..... E05F 3/222 16/49
8,390,219 B2 3/2013 Houser
8,407,937 B2 * 4/2013 Houser ..... E05F 15/63 49/139
8,499,495 B2 8/2013 Houser et al.
8,779,713 B2 * 7/2014 Burris ..... E05F 15/70 318/466
9,122,302 B2 9/2015 Huang et al.
(Continued)

FOREIGN PATENT DOCUMENTS

GB 907388 A * 10/1962 ..... E05F 15/75
WO 2015175614 A1 11/2015

OTHER PUBLICATIONS

"Berkely Brushless AC Motors" (Dec. 4, 2001).
(Continued)

*Primary Examiner* — Jerry E Redman

(57) ABSTRACT

An automatic door operator operating on standard 120V/240V AC power utilizes a servomotor for operation, and thus no separate transformer is required for the operator. The servomotor incorporates programming to limit torque, and thus no slip clutch is required in order to allow manual operation of the door. Furthermore, because the servomotor has built-in control logic, no separate digital control logic is required. Because the position of the servomotor is continuously maintained, the relative position of the door with respect to a fully opened or fully closed position is always known, and no separate external signal is required in order to monitor the door position.

19 Claims, 4 Drawing Sheets

(56) References Cited

U.S. PATENT DOCUMENTS

| | | | | |
|---|---|---|---|---|
| 9,514,583 | B2 | 12/2016 | Zasowski et al. | |
| 10,626,653 | B2 * | 4/2020 | Hucker | E05F 1/10 |
| 2002/0183008 | A1 | 12/2002 | Menard et al. | |
| 2009/0093913 | A1 * | 4/2009 | Copeland, II | E05F 1/002 700/282 |
| 2012/0227326 | A1 * | 9/2012 | Drux | E05F 15/63 49/358 |
| 2015/0106104 | A1 | 4/2015 | Clough | |
| 2015/0275564 | A1 | 10/2015 | Rosenthal et al. | |
| 2016/0024831 | A1 | 1/2016 | Houser et al. | |
| 2017/0034485 | A1 | 2/2017 | Scalisi | |
| 2019/0186191 | A1 * | 6/2019 | Eguchi | E05F 15/614 |

OTHER PUBLICATIONS

"Sweco Engineering Introduces 480 VAC Brushless Drives" (Mar. 27, 1987).
"Low Energy Automatic Door Openers" (Aug. 27, 2015).

* cited by examiner

SWINGING DOOR OPERATOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to devices for automatically opening and closing a swinging door, particularly with respect to very heavy swinging doors such as those that include lead shielding to protect persons outside of the doors from x-rays or other forms of radiation. Doors of this type are commonly found in medical and laboratory environments.

Door operators for various types of swinging doors are known. For example, U.S. Pat. No. 6,177,771, assigned to Brookfield Industries, Inc. of Thomaston, Conn., teaches an automatic door operator for heavy pivoting doors. This type of operator is powered by a DC motor, and thus requires a separate transformer in order to receive electrical power from a standard 120V/240V AC source. The operator uses an absolute position transducer that requires an external input signal in order to determine the position of the door at any given time. A controller senses the external input signal, indicating an open state for the door, a closed state for the door, or any one of a plurality of positions therebetween. The controller compares the absolute position of the door with the position indicated by the external signal, and then the controller generates a drive signal to the motor for driving the DC motor until the absolute position is substantially identical to the position indicated by the external signal. The controller for this operator is implemented as a digital programmable logic control (PLC), which is another required component adding cost and complexity to this type of operator. The absolute positon transducer is implemented as a rotary potentiometer that continuously reports position regardless of whether the door is moving. An analog to digital (A/D) converter is also required in order to convert the analog voltage signal from the potentiometer into a digital signal that can be processed by the PLC. The multitude of separate parts and complex design of this type of operator increases its manufacturing cost and raises reliability concerns.

U.S. Pat. No. 5,018,304, originally assigned to F. L. Saino Manufacturing Co. of Memphis, Tenn., teaches another type of door operator that includes a variable torque electromagnetic slip clutch. The purpose of the slip clutch is to provide a disconnect that allows the door to be manually operated (such as during a power failure or other emergency condition) without damage to the automatic operator. The inclusion of a separate slip clutch mechanism and controls therefor further complicates the design and increases the manufacturing cost of this type of operator.

References mentioned in this background section are not admitted to be prior art with respect to the present invention.

BRIEF SUMMARY OF THE INVENTION

In certain implementations, the present invention is directed to an improved automatic door operator that utilizes a servomotor and servo drive rather than a DC motor. A servomotor is brushless and thus more reliable than a DC motor and also more compact, thus reducing the footprint of the operator overall. The servomotor and servo drive operate on standard 120V/240V AC power, and thus no separate transformer is required for the operator. No separate clutch mechanism is required because the servo drive incorporates programming to limit torque. Because the servo drive has built-in control logic, no separate PLC is required. No rotary potentiometer for reading position is required, and thus no A/D converter is required for the signal from the rotary potentiometer to be read by a PLC. The servo drive includes an input port that allows for programming of the device without even the requirement of removing the operator cover; the device further can be engaged remotely via an Internet wireless connection for troubleshooting. Furthermore, the use of a servomotor and servo drive eliminates the requirement of any external transducer because the position of the servomotor is continuously maintained. Overall, the present invention in various implementations provides for a reduced parts count in the operator and thereby lowers manufacturing costs, improves reliability, and simplifies maintenance over prior art operators.

These and other features, objects and advantages of the present invention will become better understood from a consideration of the following detailed description of the preferred embodiments and appended claims in conjunction with the drawings as described following:

DETAILED DESCRIPTION OF THE PREFERRED EMBODIMENT(S)

Before the present invention is described in further detail, it should be understood that the invention is not limited to the particular embodiments described, and that the terms used in describing the particular embodiments are for the purpose of describing those particular embodiments only, and are not intended to be limiting, since the scope of the present invention will be limited only by the claims.

Figure 1:
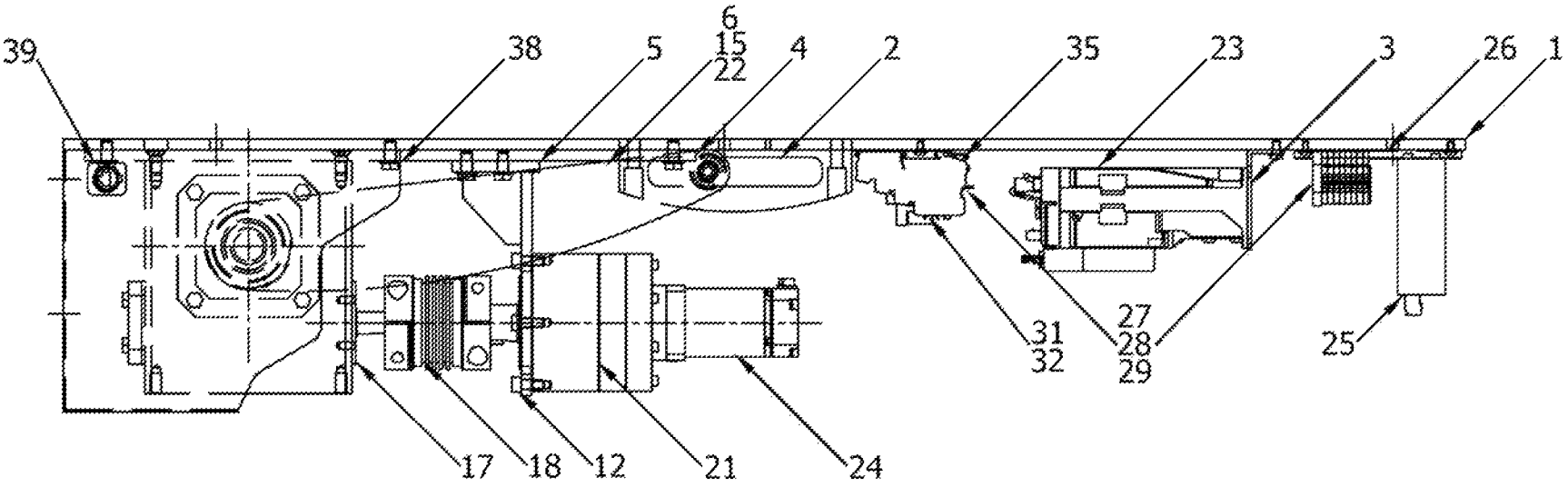
FIG. 1 is a top plan view of an operator according to an implementation of the invention.
Figure 2:
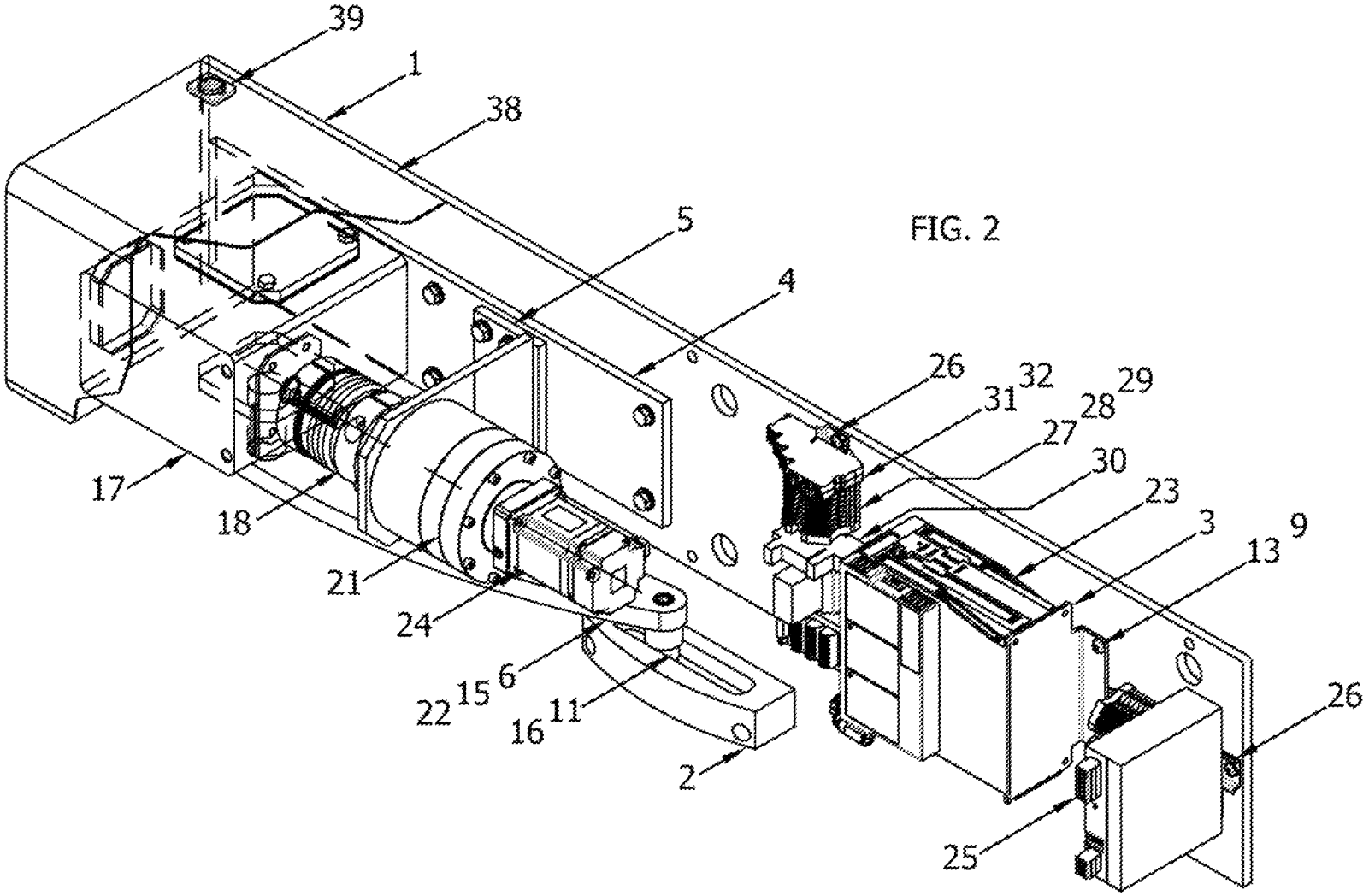
FIG. 2 is a perspective view of an operator according to an implementation of the invention.
Figure 3:
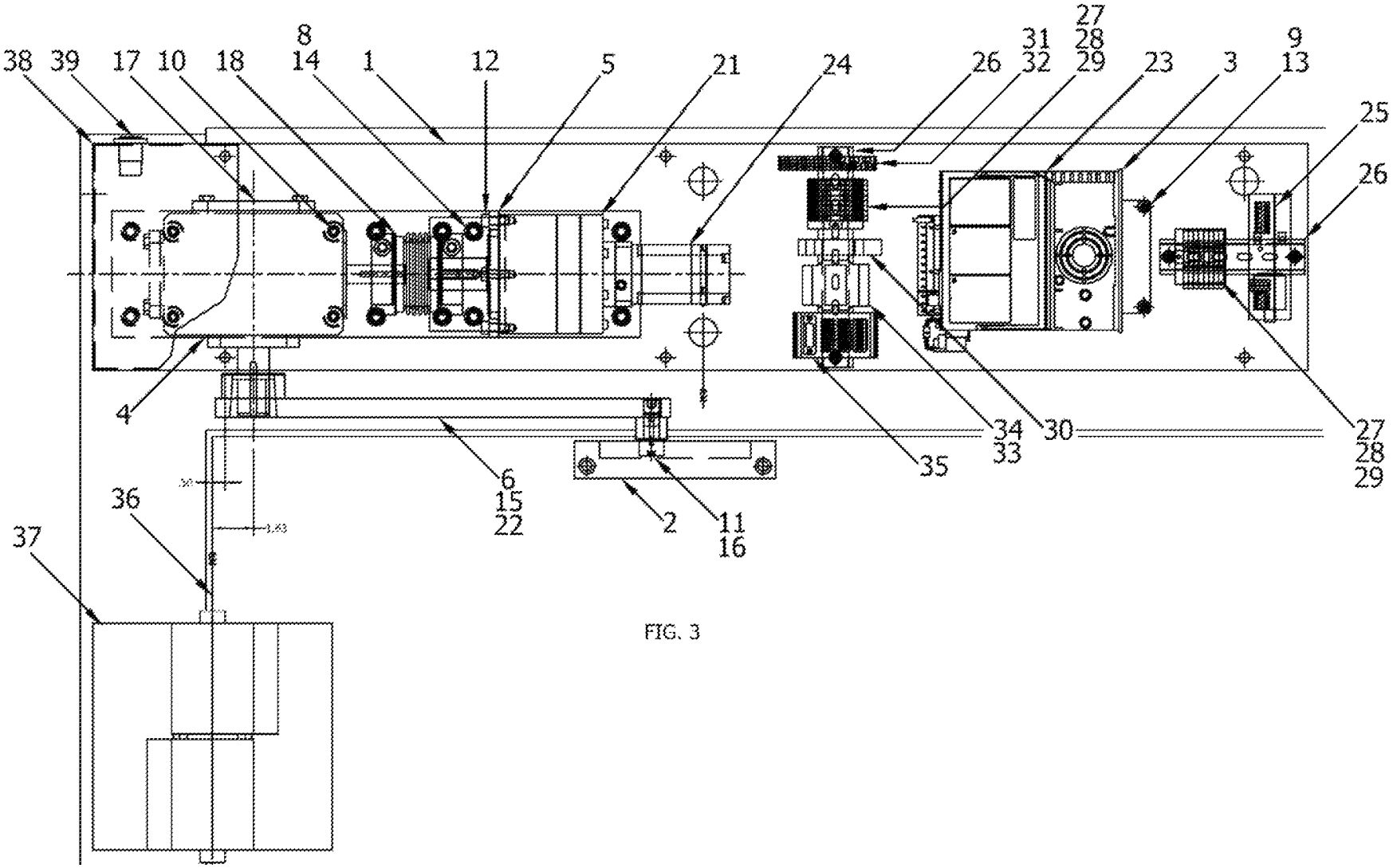
FIG. 3 is a side elevational view of an operator and door hinge assembly according to an implementation of the invention.
Figure 4:
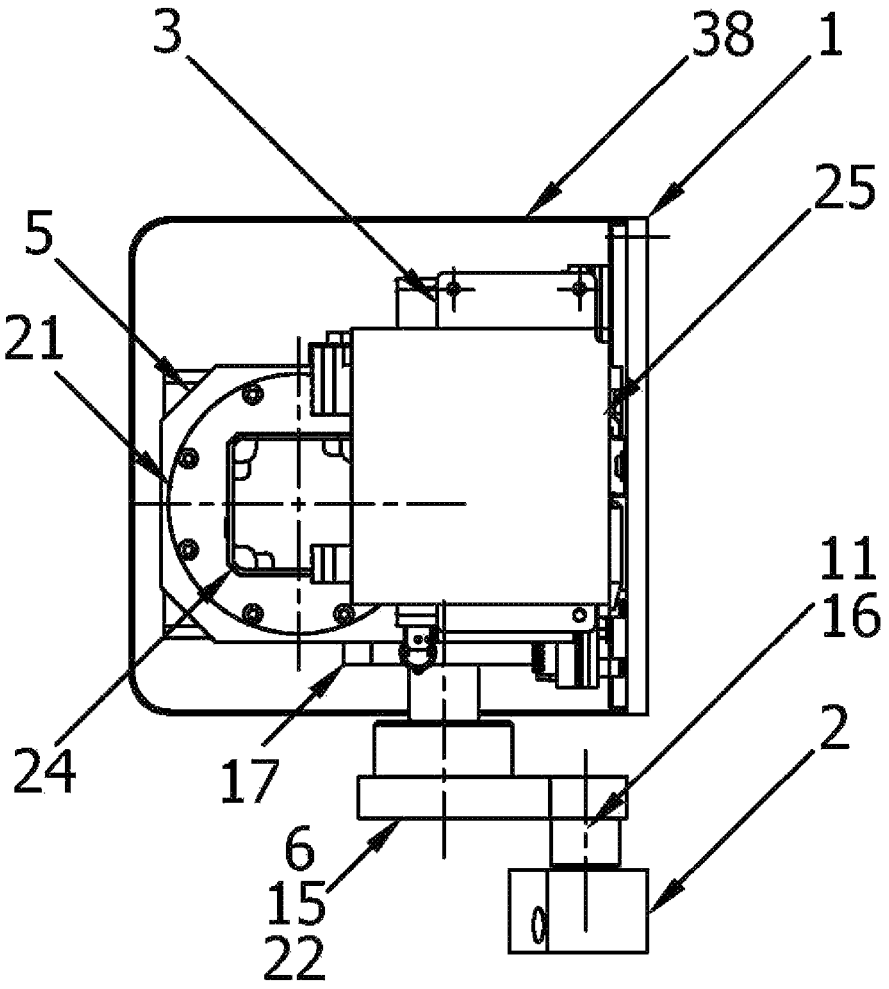
FIG. 4 is an end elevational view of an operator according to an implementation of the invention.

With reference now to FIGS. 1-4, the mechanical arrangement of the parts of an implementation of the present invention may now be described. Mounting plate 1 provides a plate on which the other components of the operator may be securely mounted. Mounting plate 1 then may be attached to a position above door 36, as shown in FIG. 3, using bolts, screws, or alternative connectors.

Cam roller block 2 is mounted below mounting plate 1 and at the top of swinging door 36. Cam roller block 2 provides a race in which cam roller 16 may move horizontally during movement of the door, as shown most clearly in FIG. 2. Cam roller set screw 11 secures cam roller 16 in place with respect to crank arm 6, extending distally from door 36 at its end where hinge 37 is mounted. At the end of crank arm 6 that is proximal to the hinged side of door 36, crank arm 6 is held in position at taper lock bushing 15 with shaft key 22, and thereby engages with the drive portion of the operator as described below. Door 36 is held in position by one or more hinges 37, about which door 36 pivots to open or close. Movement of crank arm 6, by means of the drive portion of the operator, serves to provide the automatic opening and closing feature for door 36.

Drive mount plate 4 is mounted to mounting plate 1, and provides a mounting point for the drive subassembly of the operator. Drive mount plate 4 is held in place by hex cap screws 8 with second plain washers 14 positioned under the heads of hex cap screws 8. Right angle gearbox 17 is mounted on drive mount plate 4, and engages with crank arm 6 at its lower face to provide vertical rotational drive motion to crank arm 6. Connected to right angle gearbox 17 is bellows coupling 18. Bellows coupling 18 allows for flexibility under minor misalignment conditions while maintaining rigidity under torsional loads. Gearbox 21 in turn drives bellows coupling 18, and is held in the proper position and orientation by gear head mount 5 extending outwardly from drive mount plate 4. Gearbox 21 is secured to gear head mount 5 by socket head cap screws 12. In one implementation, gearbox 21 provides a 100:1 gear reduction. Gear head mount 5 is held in place on drive mount plate 4 by means of hex cap screws 8.

The final portion of the drive subassembly is servomotor 24. Servomotor 24 is mounted to and coaxially connected together with gearbox 21 in order to provide drive motion to gearbox 21, which in turn imparts drive to bellows coupling 18, right angle gearbox 17, and eventually crank arm 6. Numerous types of commercially available servomotors may be used for servomotor 24, including, for example, the Yaskawa SGMJV brushless servomotor from Yaskawa America of Waukegan, Ill.

Moving now to the electrical subassembly, mounted directly to mounting plate 1, but positioned behind servomotor 24 on drive mount plate 4, is servo drive 23. Servo drive 23 is mounted to drive mount plate 4 by drive bracket 3, which is secured in place using button head screws 9 and first plain washers 13. A suitable device for servo drive 23 is the Yaskawa SigmaLogic single-axis combined servo amplifier/controller device. Servo drive 23, being essentially an electronic amplifier, provides electrical energy to servomotor 24, which servomotor 24 then translates into rotational mechanical energy. The electrical connections between servo drive 23 and servomotor 24 allow servo drive 23 to receive feedback from servomotor 24, allowing for correction of deviations between actual motor status and commanded motor status. Servo drive 23 is mounted to drive mount plate 4 using hexagon socket button head cap screws 9. The use of servo drive 23 eliminates any need for a PLC. Power is supplied to the unit by power supply 25, which may be implemented as a 24 VDC power supply such as the 5 A Wago 787-1622.

Mounted on a DIN rail 26, and positioned between servomotor 24 and servo drive 23, are terminal block 27, end anchor 28, and end barrier 29. Also on this DIN rail 26 are relay/socket combination 30, first terminal block 31 and second terminal block 32, relay 34, and breakout board 35. These components provide the necessary electrical connections, including power and feedback control signals, between servomotor 24 and servo drive 23.

The entire operator assembly may be housed in cover 38 to protect the internal components from damage and to prevent injury to humans who may contact energized and/or turning components, with crank arm 6 extending beneath and outside of cover 38 in order to operate door 36 by swinging door 36 on hinge or hinges 37.

Unless otherwise stated, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein. It will be apparent to those skilled in the art that many more modifications are possible without departing from the inventive concepts herein.

All terms used herein should be interpreted in the broadest possible manner consistent with the context. When a grouping is used herein, all individual members of the group and all combinations and subcombinations possible of the group are intended to be individually included. When a range is stated herein, the range is intended to include all subranges and individual points within the range. All references cited herein are hereby incorporated by reference to the extent that there is no inconsistency with the disclosure of this specification.

The present invention has been described with reference to certain preferred and alternative embodiments that are intended to be exemplary only and not limiting to the full scope of the present invention, as set forth in the appended claims.

The invention claimed is:

1. A swinging door operator, comprising:

a. a mounting plate;

b. a servomotor attached to the mounting plate;

c. a servo drive electrically connected to the servomotor by a power control signal and a feedback control signal to control the servomotor based on electrical feedback from the servomotor and to correct for deviations between an actual servomotor status and a commanded servomotor status;

d. a crank arm mechanically linked to the servo drive whereby the servo drive may pivot the crank arm; and e. a cam roller block mounted to the swinging door and slidingly engaged with the crank arm.

2. The swinging door operator of claim 1, further comprising a reduction gearbox mechanically connected between the servomotor and the crank arm.

3. The swinging door operator of claim 2, further comprising a right-angle gearbox comprising a horizontal input and a vertical output, wherein the horizontal input is mechanically connected to the reduction gearbox and the vertical output is directed downwardly from the right-angle gearbox toward the crank arm.

4. The swinging door operator of claim 3, further comprising a bellows coupling mechanically connecting the reduction gearbox to the right-angle gearbox.

5. The swinging door operator of claim 4, further comprising a gear head bracket connected to the mounting plate, wherein the reduction gearbox is mounted to the mounting plate extending outwardly from the mounting plate.

6. The swinging door operator of claim 5, further comprising a cover fittable over the mounting plate wherein the cover comprises an opening sized to allow the right-angle gearbox vertical output to extend downwardly outside of the cover.

7. The swinging door operator of claim 6, wherein the crank arm is attached to the right-angle gearbox vertical output and aligned horizontally.

8. The swinging door operator of claim 7, wherein the crank arm is aligned parallel with the servomotor and reduction gearbox.

9. The swinging door operator of claim 8, further comprising a cam roller attached at a distal end of the crank arm to engage the cam roller block, wherein movement of the crank arm causes lateral movement of the cam roller in the cam roller block.

10. An automatic door assembly, comprising:

a. a door in a doorway;

b. at least one hinge mounted at a vertical edge of the door to allow the door to swing along a vertical axis of the hinge;

c. a mounting plate positioned above the doorway;

d. a servomotor attached to the mounting plate;

e. a servo drive electrically connected to the servomotor by a power control signal and a feedback control signal to control the servomotor based on electrical feedback from the servo motor to correct for deviations between an actual servomotor status and a commanded servomotor status; and f. a crank arm mechanically linked to the servomotor, wherein operation of the servomotor in a first rotational direction causes the swing arm to swing inward toward the doorway and operation of the servomotor in a second rotational direction causes the swing arm to swing outward away from the doorway.

11. The automatic door assembly of claim 10, wherein the crank arm is aligned horizontally and parallel with the servomotor and is longitudinally aligned with the vertical axis of the hinge.

12. The automatic door assembly of claim 11, further comprising a reduction gearbox mechanically connected to the servomotor.

13. The automatic door assembly of claim 12, further comprising a right-angle gearbox comprising a horizontal input and a vertical output, wherein the horizontal input is mechanically connected to the reduction gearbox and the vertical output is directed downwardly from the right-angle gearbox to the swing arm.

14. The automatic door assembly of claim 13, further comprising a bellows coupling mechanically connecting the reduction gearbox to the right-angle gearbox.

15. The automatic door assembly of claim 14, further comprising a gear head bracket connected to the mounting plate and holding the reduction gearbox extending outwardly from the mounting plate.

16. The automatic door assembly of claim 15, further comprising a cover fittable over the mounting plate wherein the cover comprises an opening sized to allow the right-angle gearbox vertical output to extend downwardly outside of the cover to the crank arm.

17. The automatic door assembly of claim 16, further comprising a cam roller rotatably attached at a distal end of the crank arm.

18. The automatic door assembly of claim 17, further a cam roller block mounted on the door and below the mounting plate to receive the cam roller, wherein movement of the crank arm causes lateral movement of the cam roller within the cam roller block.

19. The automatic door assembly of claim 18, further comprising an uninterruptable power supply mounted on the mounting plate and electrically connected to the servo drive in order to provide electrical power to the servo drive.

* * * * *